United States Patent [19]

Yamamoto et al.

[11] 4,448,617

[45] May 15, 1984

[54] STEEL FOR A VEHICLE SUSPENSION SPRING HAVING GOOD SAG-RESISTANCE

[75] Inventors: Toshiro Yamamoto, Tokai; Ryohei Kobayashi, Chita; Mamoru Kurimoto, Tokonabe; Toshio Ozone, Nagoya, all of Japan

[73] Assignees: Aichi Steel Works, Ltd.; Chuo Hatsujo Kabushiki Kaisha, both of Aichi, Japan

[21] Appl. No.: 289,852

[22] Filed: Aug. 4, 1981

[30] Foreign Application Priority Data

Aug. 5, 1980 [JP] Japan ..... 55-108020
May 16, 1981 [JP] Japan ..... 56-74639

[51] Int. Cl.[3] ..... C22C 38/12; C22C 38/26

[52] U.S. Cl. ..... 148/36; 75/123 B; 75/123 J; 75/123 L

[58] Field of Search ..... 75/126 Q, 123 J, 123 L, 75/216 E, 126 F, 126 C, 126 P, 123 B; 148/36, 12 F, 12 B, 12.3, 12.4, 150

[56] References Cited

U.S. PATENT DOCUMENTS 3,528,088 9/1970 Seghezzi et al. ..... 148/36
4,336,081 6/1982 Hijikata et al. ..... 148/150
4,409,026 10/1983 Yamada et al. ..... 75/124

FOREIGN PATENT DOCUMENTS 142565 7/1980 Fed. Rep. of Germany .... 148/12 F
46-15212 4/1971 Japan ..... 148/36
53-5245 2/1978 Japan ..... 148/12 B
53-28516 3/1978 Japan ..... 148/36
399643 10/1933 United Kingdom .
1163640 9/1969 United Kingdom .
1187275 4/1970 United Kingdom .
1400872 7/1975 United Kingdom ..... 148/12.3
1478011 6/1977 United Kingdom .
301371 6/1971 U.S.S.R. ..... 148/36

OTHER PUBLICATIONS

Dr. Toshiro Yamamoto et al., "(557) Role of Si and Cr in Spring Steel for High Stress Use", Mar. 5, 1982, Tetsu to Hagane, Journal of the Iron and Steel Institution of Japan, p. '81-S583.

Dr. Toshiro Yamamoto et al., "(558) Precipitation Strengthened Spring Steel for High Stress Use", Mar. 5, 1981, Tetsu to Hagane, Journal of the Iron and Steel Institution of Japan, p. '81-S584.

Toshiro Yamamoto et al., "Precipitation Strengthened Spring Steel for Automobile Suspensions", Feb. 22-26, 1982, SAE Technical Paper Series 820129.

*Primary Examiner*—Peter K. Skiff
*Attorney, Agent, or Firm*—Blum, Kaplan, Friedman, Silberman and Beran

[57] ABSTRACT

A steel for use in a vehicle suspension spring having a good sag-resistance comprising by weight 0.50-0.80% carbon, 1.50-2,50% silicon, 0.50-1.50% manganese, a member or members selected from a group consisting of 0.05-0.50% vanadium, 0.05-0.50% niobium and 0.05-0.50% molybdenum, the remainder being iron together with impurities. The steel may further contain a member or members selected from a group consisting of 0.0001-0.01% boron and 0.20-1.00% chromium, and not greater than 0.0008% nitrogen.

12 Claims, 11 Drawing Figures

RESIDUAL SHEAR STRAIN (x10⁻⁴)
10
5
0
45
50
55
HARDNESS (HRC)
B1
A8
A7
A6

RESIDUAL SHEAR STRAIN (x10⁻⁴)
10
5
0
45
50
55
HARDNESS (HRC)
B1
A9

STEEL FOR A VEHICLE SUSPENSION SPRING HAVING GOOD SAG-RESISTANCE

BACKGROUND OF THE INVENTION

1. Field of the Invention

The present invention relates to a steel for a vehicle suspension spring such as a coil spring, a torsion bar or a laminated leaf spring, which has a good sag-resistance, a good fatigue resistance and a good hardenability.

2. Description of the Prior Art

There has been an increasing demand for light weight suspension springs reflecting a trend for light weight automobiles, in recent years. As an attempt to meet such a demand, it is said to be an effective approach to the reduction of weight to design the springs to have an increased stress and to use them under a high stress state.

However, if presently available spring steels are used under a high stress condition, there will be problems such that the durability will be reduced and the sagging will be increased, and consequently the level of the springs will be lowered, accordingly, the height of the vehicle will be decreased and the location of the bumper will be lowered thus leading to a serious problem for safety.

Under the circumstances, there is a strong demand for a spring steel having a good sag-resistance, which makes high stress designing possible. However, there are severe requirements for light weight suspension springs. Accordingly, it has been strongly desired to develop a spring steel having a sag-resistance superior to that of SAE 9260.

Further, in the case of a thick coil spring or a thick torsion bar made of a wire having a diameter of at least 20 mm, or a laminated leaf spring made of a sheet material having a thickness of at least 12 mm which is used for a relatively large automobile, it is difficult to harden the material to its core portion during the heat treatment, and the structure of the core portion tend to be bainite or ferrite-pearlite which has a lower hardness than a martensite structure, thus giving an inferior sag-registance.

Thus, it is desired to provide a steel for springs, which, even in a form of a thick coil spring, a thick torsion bar or a thick leaf spring, is capable of forming a martensite structure extending to the core portion by the heat treatment, and thus providing a good hardenability without a loss of a sag-resistance.

SUMMARY OF THE INVENTION

One of the object of the present invention is to provide a spring steel having a good sag-resistance.

Another object of the present invention is to provide a spring steel which has, in addition to the sag-resistance, a good hardenability which may be required depending upon its particular use as a steel for a spring.

Thus, the present invention provides a steel for a suspension spring for a vehicle, which comprises, by weight, 0.50–0.80% carbon, 1.50–2.50% silicon, 0.50–1.50% manganese and a member or members selected from a group consisting of 0.05–0.50% vanadium, 0.05–0.50% niobium and 0.05–0.50% molybdenum, the reminder being iron except for impurities normally associated with these metals.

Further, the steel of the present invention may additionally contain a member or members selected from a group consisting of 0.0001–0.01% boron and 0.20–1.00% chromium, and not more than 0.0008% nitrogen.

BRIEF DESCRIPTION OF THE DRAWINGS

A better understanding of the prior art and of the present invention will be obtained by reference to the detailed description below, and to the attached drawings, in which.

DETAILED DESCRIPTION OF THE PREFERRED EMBODIMENTS

The present invention relates to a steel for a vehicle suspension spring having a good sag-resistance. The steel is a high silicon-content steel which fundamentally contains by weight 0.5–0.80% carbon, 1.50–2.50% silicon and 0.5–1.50% manganese and which further contains one or more elements selected from vanadium, niobium and molybdenum. Further, the steel of the invention may additionally contain one or both elements selected from boron and chromium, and nitrogen.

Now, the mechanism of the improvement of the sag-resistance of the steel according to the present invention will be described.

Vanadium, niobium and molybdenum form carbides in the steel. The vanadium carbide, niobium carbide and molybdenum carbide (hereinafter referred to as "alloy carbide") are dissolved in austenite by the heating at the time of the quenching operation, and when rapidly cooled for quenching, a martensite structure is obtainable in which these elements are supersaturated in a solid solution state. When tempered, a fine alloy carbide starts to reprecipitate during the tempering operation, whereby the movement of dislocation is prevented, and a secondary hardening takes place to give an increased hardness superior to the steel not incorporated with vanadium, niobium and molybdenum, and to improve the sag-resistance.

Further, an alloy carbide not dissolved in the austenite by the heating at the time of the quenching operation, serves to refine austenite grains and to prevent coarsening of the grains. Such fine grains serve to reduce the movement of dislocation and thus to improve the sag-registance.

Furthermore, the steel of the present invention has an improved temper softening resistance as well as the sag registance, and thus provides a wider range of the tempering temperature than the conventional steels to obtain a range of hardness. Namely, the steel of the present invention thus incorporated with niobium and vanadium undergoes a secondary hardening by the reprecipitation of the alloy carbide in the tempering operation subsequent to the quenching operation which may be carried out from the austenitizing temperature normally used for the usual spring steels. This means that in the case where the same tempered hardness range is aimed, it is possible thereby to obtain a wider temperature range for tempering than with a conventional steel, and it is possible to obtain the aimed hardness assuredly.

Figure 1:
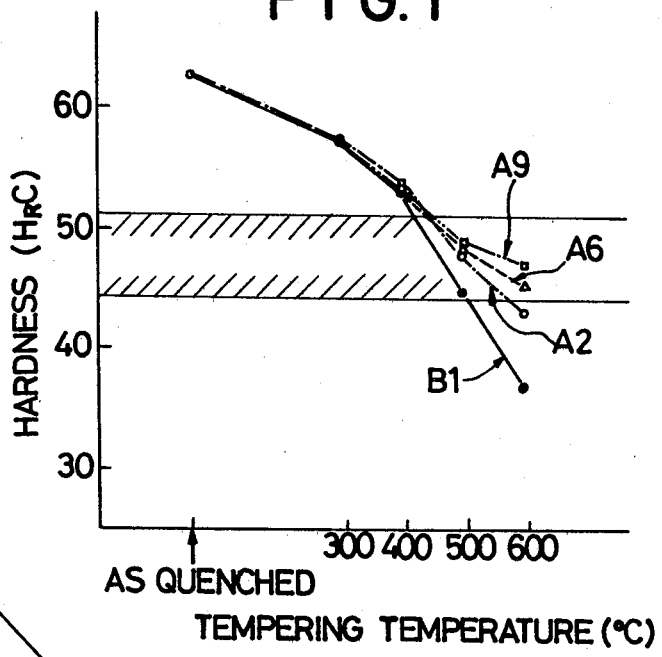
FIGS. 1 and 2 are diagrams illustrating the relationship between the tempering temperatures and the hardness.

To make this point clearer, the below mentioned A2 steel containing 0.20% of vanadium, A6 steel containing 0.25% of vanadium and 0.22% of niobium, A9 steel containing 0.23% of vanadium, 0.21% of niobium and 0.22% of molybdenum, and B1 steel as SAE 9260 were tempered at a temperature of from 300° to 600° C. and their hardness was measured, and the results thereby obtained are shown in FIG. 1. The same Figure also shows a hardness range corresponding to the spring hardness range of HRC 44.5 to 51.0 as stipulated in the Japanese Automobile Standard JASO C605 "Coil Springs for Automobile Suspension". It is apparent from FIG. 1 that the steels according to the present invention such as A2 steel, A6 steel and A9 steel in which an appropriate amount of vanadium, niobium or molybdenum is incorporated, provide wider tempering temperature ranges corresponding to their hardness than the conventional steels.

The present inventors have conducted an extensive research to obtain a sufficient sag-resistance also for the above mentioned thick springs, and have succeeded to develop a spring steel having a good hardenability without impairing the sag-resistance and which, even in a form of a thick coil spring, a thick torsion bar or a thick laminated leaf spring, provides a martensite structure to the core thereof by the heat treatment, by adding to a high silicon-content spring steel an appropriate amount of one or both of vanadium and niobium, and further adding one or both of boron and chromium and at most 0.0080% of nitrogen.

Now, the mechanism for the improvement of the sag-resistance and the hardenability by boron will be described.

Atomic boron plays an effective role for the hardenability. The atomic boron is dissolved interstitially in crystals, and it is particularly apt to penetrate in the vicinity of the dislocation. The dislocation thus penetrated by boron is hardly movable, and the sagging is thereby effectively reduced.

Figure 2:
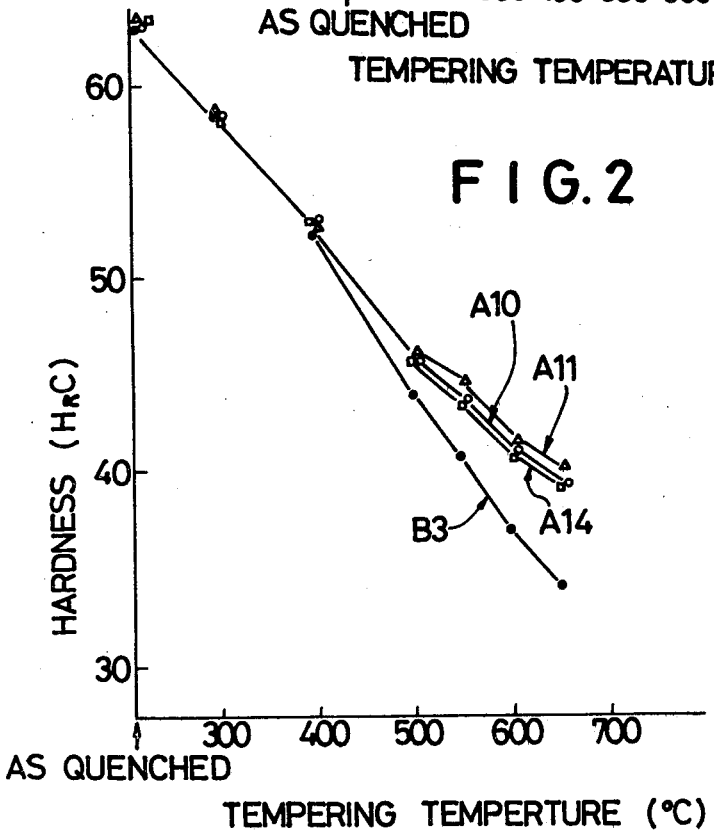

To make this point clear, and to illustrate the effectiveness of boron, the below mentioned A10 steel containing 0.28% of vanadium and 0.0029% of boron, A11 steel containing 0.21% of vanadium, 0.09% of niobium and 0.0021% of boron and A14 steel containing 0.26% of vanadium, which are composed of a high silicon content steel as the base, and B3 steel which is a presently available high silicon content steel, were tempered at a temperature of from 300°to 600° C., and their hardness was measured, and the results thereby obtained are shown in FIG. 2. It is apparent from FIG. 2 that with respect to A10 and A11 steels containing vanadium, niobium and boron and A14 steel containing vanadium alone, a hardness increment peak indicating the occurance of a secondary hardening is observed at a tempering temperature in the vicinity of 550° C. even in a quenching operation from a usual austenitizing temperature. From this, it is apparent that the occurance of the secondary hardening is not impaired by the addition of boron and it is also apparent that the precipitation strengthening can adequately be utilized at a tempering temperature which is used to obtain a hardness in the vicinity of the stipulated hardness range (i.e. HRC 44.5 to 51.0) for the presently available spring steels.

Figure 3:
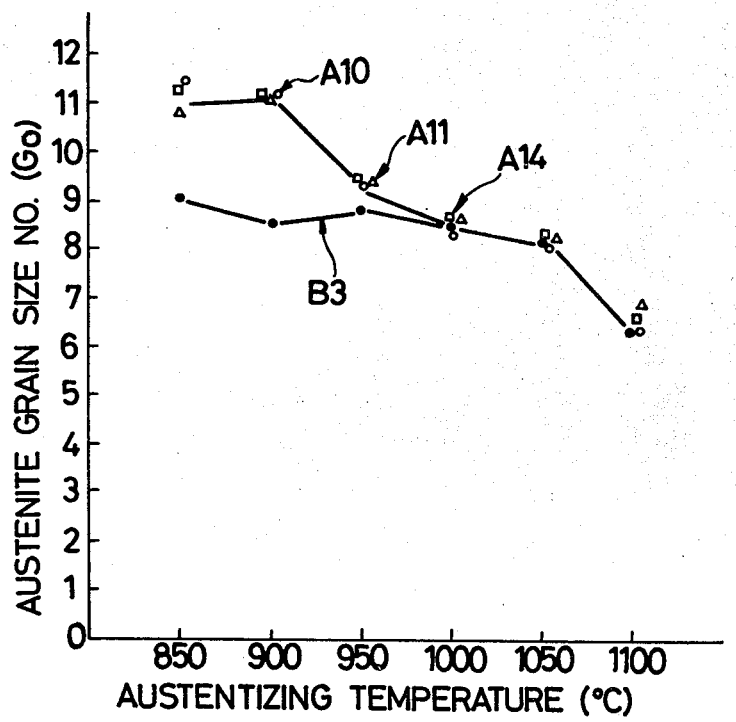
FIG. 3 is a diagram illustrating the relationship between the austenitizing temperatures and the austenite grain size numbers.

Further, FIG. 3 shows austenite grain sizes of the above steels as measured by an oxidation method after heating at an austenitizing temperature of from 850° C. to 1100° C. It is apparent from FIG. 3 that A10 and A11 steels containing vanadium, niobium and boron have an austenite grain size equivalent to that of A14 steel containing vanadium alone. This indicates that the effectiveness of the alloy carbide for the refinement of crystal grains and for the prevention of coarsening of the austenite grains, is not impared by the addition of boron.

Figure 4:
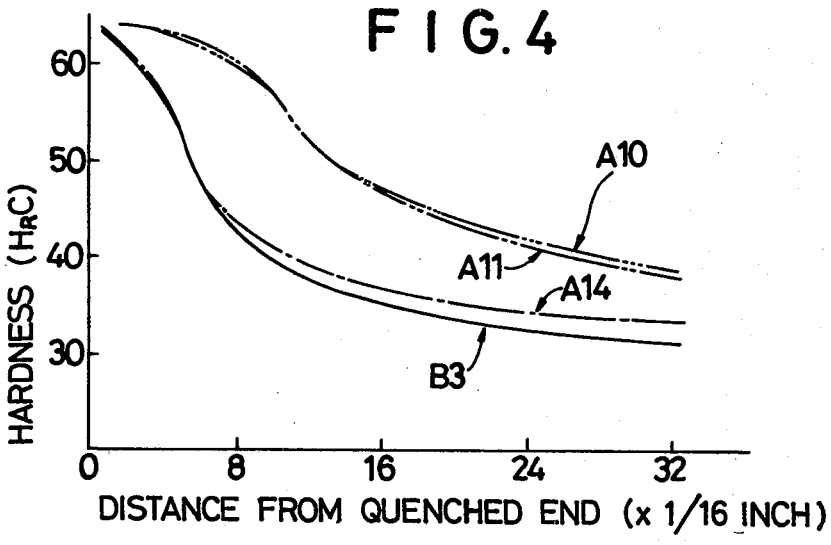
FIG. 4 is a diagram illustrating the Jominy curves.
Figure 5:
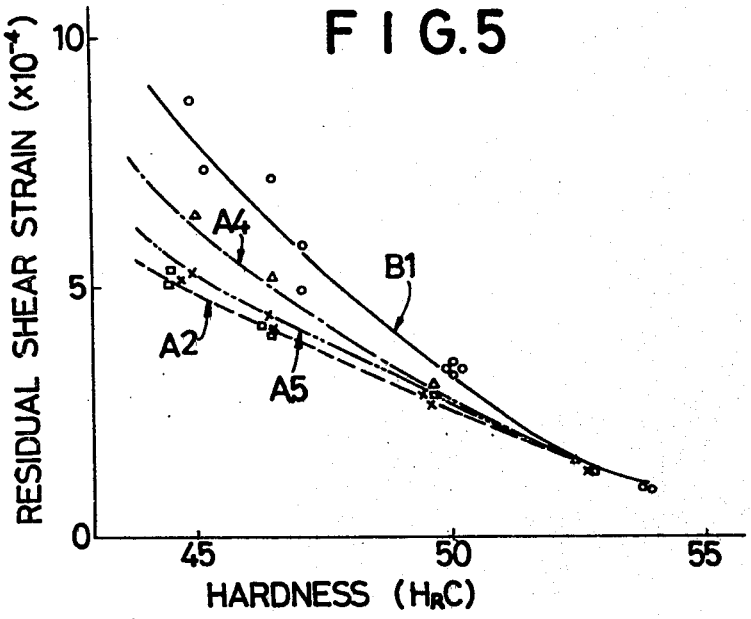
FIGS. 5 to 10 are diagrams illustrating the relationship between the hardness and the residual shear strains.
Figure 6:
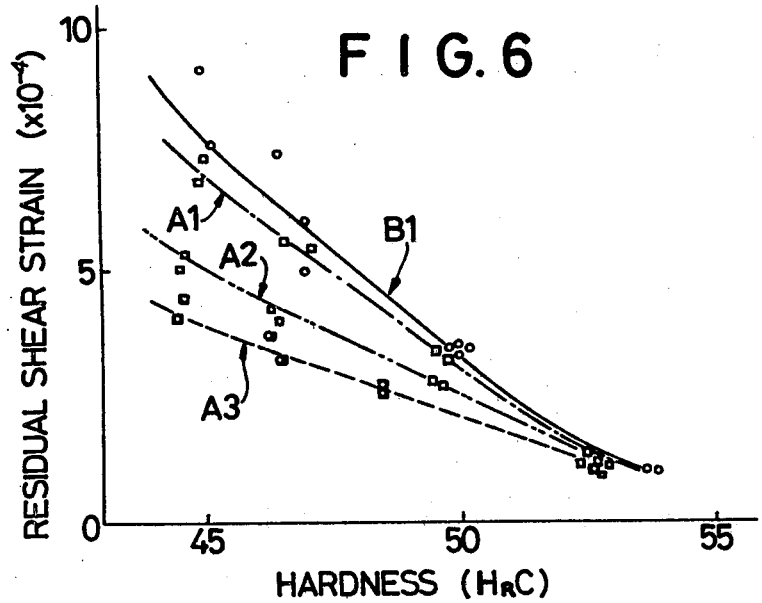
Figure 7:
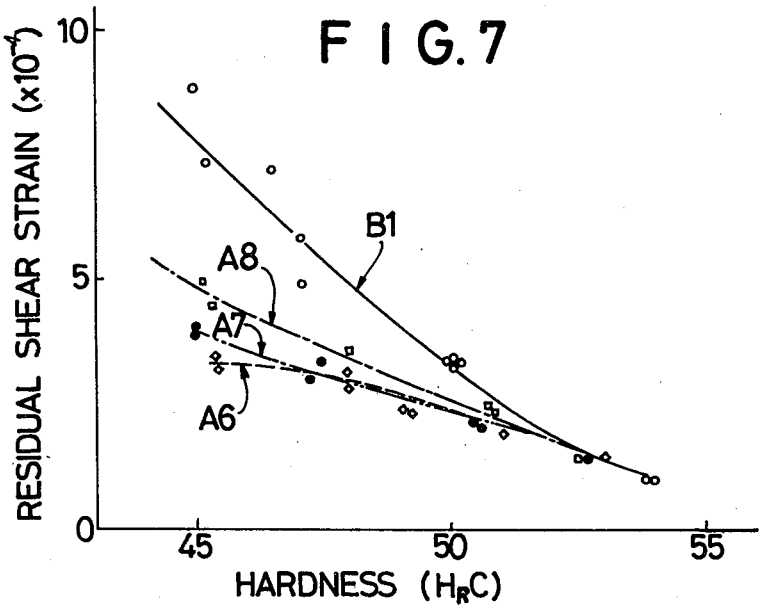
Figure 8:
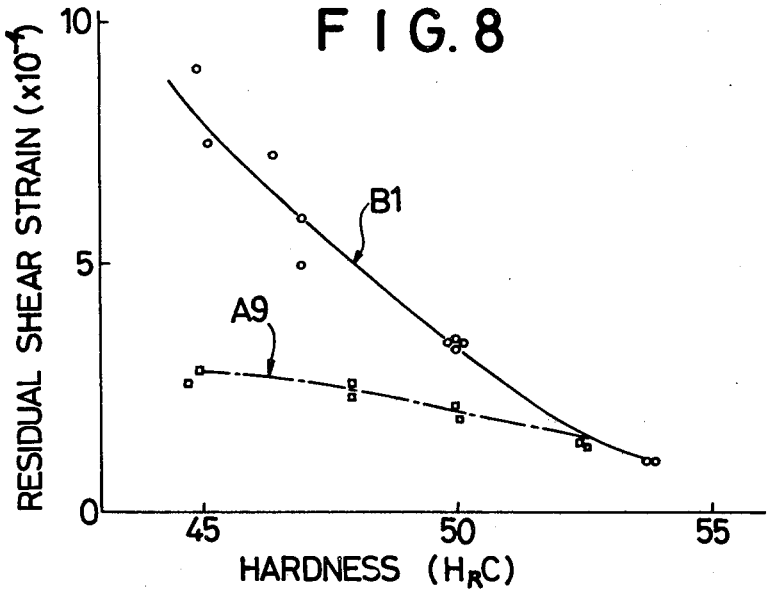

Furthermore, the Jominy curves of the above steels are shown in FIG. 4. As is apparent from FIG. 4, A10 and A11 steels containing boron have a remarkably improved hardenability as compared with A14 and B3 steels containing no boron.

As described above, the steel of the present invention is composed of a high silicon content steel incorporated with proper amounts of vanadium, niobium and boron together and thus is a spring steel having superior hardenability and sag-registance utilizing the effectiveness of the secondary hardening and the refinement of crystal grains by the alloy carbide and the effectiveness for the improvement of the hardenability and for the fixation of the dislocation by atomic boron.

Now, the reasons for restricting the composition for the steel of the present invention will be described.

The chemical composition of the steel of the present invention comprises by weight 0.50–0.80% carbon, 1.50–2.5% silicon, 0.50–1.50% manganese and one or more selected from a group consisting of 0.05–0.50% vanadium, 0.05–0.50% niobium and 0.05–0.50% molybdenum, the rest being essentially iron, or it may further contain one or both of 0.0005–0.01% boron and 0.20–1.0% chromium, and not more than 0.0080% nitrogen.

The reason for restricting the amount of carbon to 0.50–0.80% is that if the amount is less than 0.50%, no sufficient strength for a spring steel for a high stress use is obtainable by the quenching and tempering, and if the amount exceeds 0.80%, a hyper-eutectoid steel results which has a substantially reduced toughness.

The reason for restricting the amount of silicon to 1.50–2.5% is that if the amount is less than 1.50%, silicon is dissolved in ferrite and thus does not provide a sufficient effectiveness in the strengthening of the matrix and in the improvement of the sag-registance, and if the amount exceeds 2.5%, the effectiveness for the improvement of the sag-registance is saturated and there is a possibility of undesirable formation of free carbon by the heat treatment.

The reason for restricting the amount of manganese to 0.50–1.50% is that if the amount is less than 0.50%, no adequate strength for a spring steel is obtainable and no adequate hardenability is obtainable, and if the amount exceeds 1.50%, the toughness tends to decrease.

Each of vanadium, niobium and molybdenum plays a role of improving the sag-resistance of the steel according to the present invention.

The reason for restricting the amount of each of vanadium, niobium and molybdenum to 0.05–0.50% is that if the amount is less than 0.05%, the above effectiveness is not sufficiently obtainable, and if the amount exceeds 0.50%, the effectiveness is saturated and the amount of the alloy carbide not dissolved in the austenite increases and produces large aggregates acting as non-metallic inclusions thus leading to a possibility of decreasing the fatigue strength of the steel.

These vanadium, niobium and molybdenum may be added alone independently of the other two, or they may be added as a combination of two or three, whereby it is possible to form a preferred system where their solubilization in the austenite starts at a lower temperature than the case where vanadium, niobium and molybdenum are added alone, and the precipitation of the fine alloy carbide during the tempering operation, facilitates the secondary hardening thereby further improving the sag-resistance.

The reason for restricting the amount of boron to 0.0005–0.01% is that if the amount is less than 0.0005%, no adequate improvements in the hardenability and sag-resistance are obtainable and if the amount exceeds 0.01%, boron compounds precipitate which lead to hot brittleness.

The reason for restricting the amount of chromium to 0.20–1.0% is that if the amount is less than 0.20%, no adequate effectiveness for hardenability is obtainable, and if the amount exceeds 1.0%, the uniformity of the structure is impaired in a high silicon content steel as used in the present invention and consequently the sag-resistance is impaired.

The reason for restricting the amount of nitrogen to not more than 0.0080% is to prevent a loss of the effectiveness of boron through the reaction of the boron and nitrogen to reduce the effective amount of atomic boron.

Now, the features of the steel of the present invention will be described with reference to Examples and in comparison with the conventional steels.

EXAMPLE 1

Table 1 shows chemical compositions of sample steels.

TABLE 1

| | Chemical compositions (% by weight) | | | | | | | | | |
|---|---|---|---|---|---|---|---|---|---|---|
| | C | Si | Mn | P | S | V | Nb | Mo | Al | N |
| A1 | 0.61 | 1.97 | 0.83 | 0.020 | 0.008 | 0.07 | | | 0.030 | 0.011 |
| A2 | 0.58 | 2.14 | 0.84 | 0.025 | 0.009 | 0.20 | | | 0.024 | 0.012 |
| A3 | 0.60 | 1.95 | 0.80 | 0.018 | 0.008 | 0.33 | | | 0.033 | 0.011 |
| A4 | 0.58 | 2.10 | 0.86 | 0.026 | 0.010 | | 0.19 | | 0.022 | 0.012 |
| A5 | 0.59 | 2.12 | 0.85 | 0.025 | 0.009 | | | 0.21 | 0.025 | 0.011 |
| A6 | 0.58 | 2.17 | 0.84 | 0.025 | 0.009 | 0.25 | 0.22 | | 0.027 | 0.018 |
| A7 | 0.57 | 2.14 | 0.85 | 0.026 | 0.010 | 0.22 | | 0.20 | 0.029 | 0.012 |
| A8 | 0.59 | 2.15 | 0.87 | 0.025 | 0.010 | | 0.19 | 0.22 | 0.023 | 0.011 |
| A9 | 0.61 | 1.98 | 0.80 | 0.017 | 0.008 | 0.23 | 0.21 | 0.22 | 0.033 | 0.012 |
| B1 | 0.59 | 2.17 | 0.86 | 0.025 | 0.010 | | | | 0.018 | 0.012 |
| B2 | 0.59 | 1.97 | 0.81 | 0.020 | 0.009 | | | | 0.036 | 0.013 |

In Table 1, A1 to A9 steels are the steels of the present invention, and B1 and B2 steels are the conventional steels, i.e. SAE 9260.

The sample steels of Table 1 were cast, then subjected to hot rolling at a rolling ratio of at least 50, and subjected to quenching and tempering treatments at temperatures sufficient to provide a tensile strength of about 180 kgf/mm$^2$. The 0.2% proof stress, elongation, reduction of area, impact values and torsional strength thereby obtained are shown in Table 2. Tensile strength, 0.2%-proof stress, elongation, and reduction of area are measured using standard 0.500-in. (12.5-mm) round test specimens with 2-in. gauge length specified in ASTM A370. Impact testing was performed using 10×10 mm simple beam impact specimens with 2-mm deep U-notch modified from type A specimens specified in ASTM A370. The torsional strength was measured with use of specimens having a diameter of 9 mm at the parallel portions.

TABLE 2

| | Tensile strength (kgf/mm$^2$) | 0.2% Proof stress (kgf/mm$^2$) | Elongation (%) | Reduction of area (%) | Impact values (kgfm/cm$^2$) | Torsional strength (kgf/mm$^2$) |
|---|---|---|---|---|---|---|
| A1 | 181 | 173 | 13 | 36 | 2.2 | 145 |
| A2 | 180 | 173 | 11 | 39 | 2.7 | 145 |
| A3 | 181 | 173 | 12 | 33 | 2.5 | 147 |
| A4 | 181 | 173 | 15 | 42 | 2.9 | 148 |
| A5 | 182 | 174 | 12 | 32 | 2.5 | 147 |
| A6 | 180 | 175 | 12 | 29 | 2.3 | 150 |
| A7 | 181 | 176 | 12 | 33 | 2.6 | 150 |
| A8 | 187 | 175 | 14 | 33 | 2.4 | 148 |
| A9 | 182 | 176 | 11 | 30 | 2.0 | 150 |
| B1 | 178 | 168 | 13 | 41 | 2.3 | 144 |
| B2 | 178 | 166 | 12 | 36 | 2.4 | 144 |

As is apparent from Table 2, A1 to A9 steels of the present invention in both cases where vanadium, niobium and molybdenum are added alone and where they are added in a combination, exhibit values equivalent or superior to those of the conventional B1 and B2 steels, and with respect to the steels of the present invention, there is no substantial difference between the respective specimens.

Using the above sample steels as the base materials, coil springs having the characteristics shown in Table 3 were prepared, and subjected to quenching and tempering treatments to bring the final hardness to be HRC 45 to 55. Then, they are subjected to pre-setting to bring the shear stress of bars to be $\tau=115$ kg/mm$^2$, thereby to obtain specimens for sagging tests. These specimens were brought under a load sufficient to give a shear stress of the bars being $\tau=105$ kg/mm$^2$ at a constant temperature of 20° C., and after the expiration of 96 hours (hereinafter referred to as "long hour loading"), the sagging of the coil springs was measured.

TABLE 3

| Characteristics of coil springs | |
|---|---|
| Bar diameter (mm) | 13.5 |
| Bar length (mm) | 2470 |
| Average coil diameter (mm) | 120 |
| Number of turns | 6.75 |
| Effective number of turns | 4.75 |
| Spring rate (kgf/mm) | 4.05 |

Further, the sagging corresponding to the hardness of the above specimens is shown in FIGS. 5 to 8. As is apparent from FIGS. 5 to 8, the steels of the present invention in both cases of A1 to A5 steels where vanadium, niobium and molybdenum are added alone and of A6 to A9 steels where vanadium, niobium and molybdenum are added in a combination, have a sag-resistance superior to that of the conventional B1 steel. Among the steels of the present invention, the steels containing vanadium, niobium and molybdenum in a combination have a sag-resistance superior to the steels in which vanadium, niobium or molybdenum is added alone.

Further, in order to determine the sagging, a load $P_1$ required to compress the coil springs to a predetermined level prior to the above mentioned long hour loading and a load $P_2$ required to compress them to the same level after exerting the long hour loading, were measured, and the sagging was calculated by applying the difference $\Delta P = P_1 - P_2$ to the following equation, and sagging was evaluated by values having a unit of shear strain and referred to as "residual shear strain".

$$\gamma R = \frac{1}{G} \cdot K \frac{8D}{\pi d^3} \Delta P$$

G: Shear modulus (kgf/mm²)
D: Average coil diameter (mm)
d: Bar diameter (mm)
K: Wahl's coefficient (A coefficient depending upon the shape of a coil spring)

Further, with respect to coil spring bars made of A1 to A9 steels and B1 steel having the same characteristics as above, a load to give a shear stress within a range of from 10 to 110 kgf/mm² were repeatedly exerted for fatigue tests. Upon the repetition of the loading for 200,000 times, no breakage was observed in any one of the coil springs.

EXAMPLE 2

Table 4 shows chemical compositions of sample steels used in this Example.

TABLE 4

| | Chemical composition (% by weight) | | | | | | | |
|---|---|---|---|---|---|---|---|---|
| | C | Si | Mn | V | Nb | B | Cr | N |
| A10 | 0.61 | 2.11 | 0.87 | 0.28 | | 0.0029 | 0.12 | 0.0061 |
| A11 | 0.59 | 2.07 | 0.86 | 0.21 | 0.09 | 0.0021 | 0.11 | 0.0056 |
| A12 | 0.58 | 2.09 | 0.84 | 0.25 | | | 0.49 | 0.0074 |
| A13 | 0.58 | 2.12 | 0.85 | 0.25 | 0.10 | | 0.50 | 0.0069 |
| A14 | 0.57 | 2.04 | 0.87 | 0.26 | | | 0.11 | 0.0125 |
| A15 | 0.59 | 2.11 | 0.85 | 0.19 | 0.11 | | 0.11 | 0.0132 |
| B3 | 0.59 | 2.11 | 0.86 | | | | 0.13 | 0.0128 |

In Table 4, A10 to A13 are the steels of the present invention, and A14 and A15 are comparative steels composed of a high silicon content steel incorporated with vanadium and niobium. B3 is the conventional steel i.e. SAE 9260.

The same steels of Table 4 were cast, then subjected to hot rolling at a rolling ratio of at least 50, and subjected to a heat treatment to bring the tempered hardness to a level of HRC 48. The tensile strength, 0.2% proof stress, elongation, reduction of area, impact values and torsional strength thereby obtained are shown in Table 5.

Tensile strength, 0.2%-proof stress, elongation, and reduction of area are measured using standard 0.500-in. (12.5-mm) round test specimens with 2-in. gauge length specified in ASTM A370. Impact testing was performed using 10×10 mm simple beam impact specimens with 2-mm deep U-notch modified from type A specimens specified in ASTM A370, and the torsional strength was measured with use of specimens having a diameter of 9 mm at the parallel portions.

TABLE 5

| | Tensile strength (kgf/mm²) | 0.2% Proof stress (kgf/mm²) | Elongation (%) | Reduction of area (%) | Impact values (kgfm/cm²) | Torsional strength (kgf/mm²) |
|---|---|---|---|---|---|---|
| A10 | 165 | 156 | 13 | 37 | 3.0 | 140 |
| A11 | 166 | 157 | 12 | 36 | 3.0 | 139 |
| A12 | 164 | 154 | 15 | 39 | 3.2 | 140 |
| A13 | 165 | 158 | 13 | 36 | 3.1 | 141 |
| A14 | 166 | 157 | 12 | 35 | 3.1 | 141 |
| A15 | 164 | 157 | 14 | 36 | 3.0 | 140 |
| B3 | 165 | 153 | 15 | 40 | 3.0 | 139 |

As is apparent from Table 5, A10 to A13 steels containing boron and chromium according to the present invention have mechanical properties equivalent to those of A14 and A15 steels containing vanadium and niobium as the comparative steels, and they have a 0.2% proof stress superior to that of B3 steel as the conventional steel.

Using the above sample steels as the base materials, torsion bars having the characteristics shown in Table 6 and a diameter of 30 mm at the parallel portions, were prepared, subjected to quenching and tempering treatments to bring the final hardness to a level of HRC 45 to 55 and then to a shot-peening treatment, thereby to obtain specimens for sagging tests. Prior to the sagging test, a torque to give a shear stress $\tau = 110$ kgf/mm² to the surface of the parallel portions of the specimens, were exerted to both ends of the specimens, and a pre-setting was thereby applied. After the pre-setting, a torque to give a shear stress $\tau = 100$ kgf/mm² was exerted and the specimens were kept to stand in that state for 96 hours. Thereafter, the residual shear strain was calculated by an equation $\gamma_R = \Delta\theta \cdot d/2l$ based on the decrease of the tortional angle, where $Y_R$ is a residual shear strain, $\Delta\theta$ is a decrease (rad) of the torsional angle and d is a diameter (mm) of the bar.

TABLE 6

| characteristics of the torsion bars | |
|---|---|
| | A10-A15, B3 |
| Bar diameter | 30.0 mm |
| Effective bar length | 840 mm |
| Spring rate | 12,723 kgfmm/deg |

Figure 9:
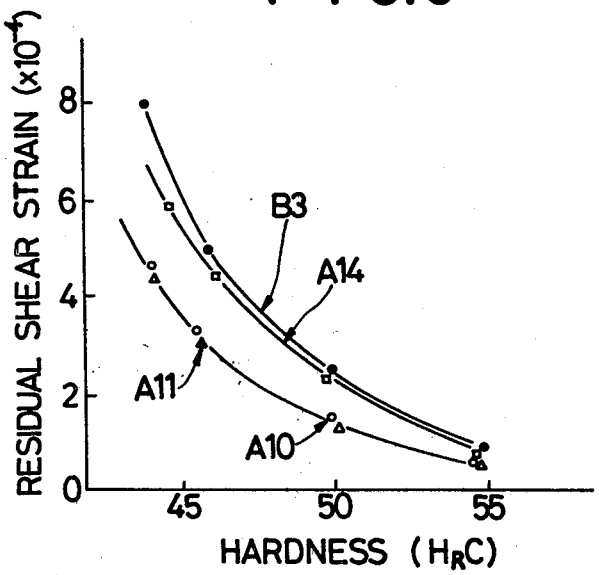
Figure 10:
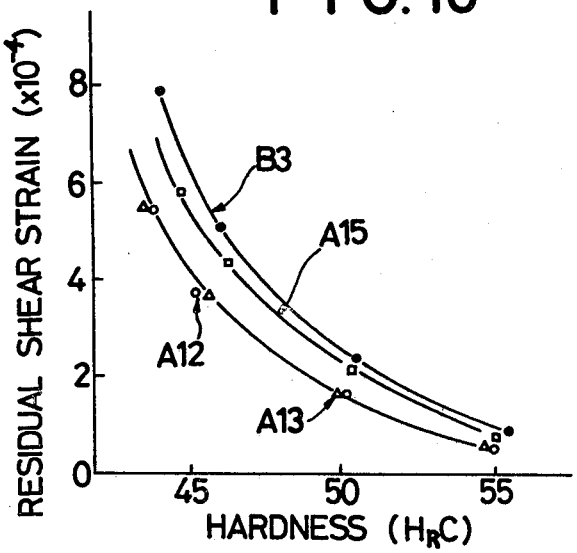

The sagging corresponding to the hardness of the above specimens is shown in FIGS. 9 and 10. As is apparent from FIGS. 9 and 10, specimens having a diameter of 30 mm at the parallel portions and prepared from A10 to A13 steels of the present invention containing boron are remarkably superior in the sagging to B3 steel as the conventional steel, and they also show better values than A14 steel as the comparative steel. This is considered to be due to the fact that by the incorporation of boron, it was possible to obtain by the quenching treatment fully hardened martensite structure to the core thereof without impairing the sag-registance even when a torsion bar having a diameter of 30 mm was used, and at the same time the boron penetrated interstitially into crystals in the vicinity of the dislocation thereby preventing the movement of the dislocation to effectively reduce the sagging.

Further, to the above torsion bars prepared from A10 to A13 steels as the steels of the present invention and A14 and A15 steels as the comparative steels, a load to give a shear stress of 60±50 kgf/mm$^2$ was repeatedly exerted for fatigue tests. Upon exerting the repeated load for 200,000 times, no breakage was observed in any one of the torsion bars, and it was thereby confirmed that no adverse effect was brought about to the fatigue life by the addition of boron.

As described hereinabove, the steel of the present invention comprises a conventional high silicon content steel in which proper amounts of vanadium and niobium are added alone or in a combination, and which further contains one or both of boron and chromium, and not more than 0.0080% of nitrogen, whereby the hardenability and sag-registance of the conventional high silicon content spring steel have successfully been remarkably improved. At the same time, the steel of the present invention is as good as the conventional steels in the fatigue resistance and toughness which are required for spring steels, and it is extremely useful for practical applications particularly as a steel for a vehicle suspension spring.

Now, a high temperature rapid heating operation will be described which further improves the sag-resistance of the steel of the present invention.

Figure 11:
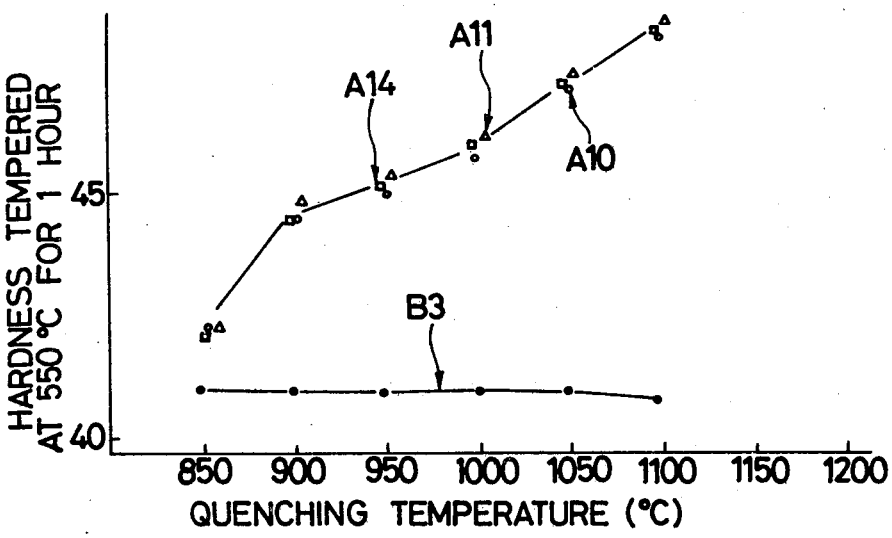
FIG. 11 is a diagram showing the relationship between the quenching temperatures and the hardness.

FIG. 11 shows the hardness of the above steels which were treated at austenitizing temperatures within a range of from 850° to 1100° C. and tempered at 550° C. It is seen from FIG. 11 that with respect to A10, A11 and A14 steels, except for B3 steel, the hardness is increased with an increase of the austenitizing temperature. This indicates that the amount of the alloy carbide dissolved in the austenite phase increases with an increase of the austenitizing temperature and the secondary hardening is thereby facilitated remarkably.

Namely, by setting the heating temperature for austenitizing at a higher level of from 900° to 1200° C. than the conventional method, it is possible to increase the amounts of carbides of vanadium, niobium and molybdenum dissolved in the austenite. Accordingly, it is thereby possible to increase the precipitation of the fine carbides in the subsequent tempering and to further facilitate the secondary hardening, whereby it is possible to further improve the sag-resistance.

However, if the heating is conducted at a temperature as high as from 900° to 1200° C. for a long period of time by the conventional heating method such as with a heavy oil, there will be adverse effects such that decarburization takes place on the steel surface, the surface becomes rough, the fatigue life is shortened and the austenite grains are coarsened.

Under these circumstances, the present inventors have conducted extensive researches, and have found that by rapidly heating the steel materials to a temperature of from 900° to 1200° C. at the time of austenitizing, it is possible to dissolve carbides of vanadium, niobium and molybdenum in a great amount in the austenite without bringing about decarburization and surface roughening, and by holding the steel materials at that temperature for a predetermined period of time, thereafter quenching them and then subjecting them to tempering at a temperature of from 400° to 580° C., it is possible to precipitate fine carbides in a great amount to further facilitate the secondary hardening, whereby it is possible to further improve the sag-resistance.

Now, the reasons for restricting the high temperature rapid heating will be explained.

The reason for restricting the heating temperature for austenitizing to from 900° to 1200° C., is that if the temperature is lower than 900° C., it is impossible to adequately dissolve vanadium, niobium and molybdenum in the austenite especially when they are added alone, and if the temperature exceeds 1200° C., it is likely that decarburization or surface roughening forms on the surface of the steel materials.

Further, the reason for carrying out the heating rapidly, is that if the heating rate is less than 500° C./min, the heating time at the high temperature is required to be long thereby leading to adverse effects such as the formation of decarburization on the surface of the steel materials, the surface roughening, the decrease of the fatigue life, and the coarsening of the austenite grains.

To carry out the rapid heating at a rate of at least 500° C./min, it is preferred to use a high frequency induction heater or a direct current heating apparatus.

Further, the reason for restricting the tempering temperature to from 400° to 580° C. is that in the steel of the present invention, carbides of vanadiaum, niobium and molybdenum dissolved in the austenite, are precipitated as a fine alloy carbide during the tempering treatment and a secondary hardening is thereby caused to take place, whereby even when the tempering is carried out at a temperature as high as 580° C., the decrease of the hardness is smaller than the conventional steels and it is possible to obtain a hardness of at least HRC 44.5.

This will be explained in more detail with reference to the following Example.

EXAMPLE 3

As the sample materials, there were used the steels of the invention identified by A2, A4, A6, A10 and A11 in Tables 1 and 4, and the conventional steel identified by B1 in Table 1 and composed substantially of SAE 9260.

The sample steels were cast, subjected to hot rolling at a rolling ratio of at least 50, and then rapidly heated at a heating rate of 1000° C./min or 5000° C./min to 950° C., 1050° C. and 1150° C. at the time of quenching and then tempered to give a tempered hardness of about HRC 48. The sagging (i.e. the residual shear strain), decarburization and austenite grain sizes thereby obtained are shown in Table 7.

The measurement of the sagging was carried out in the same manner as in Examples 1 and 2 with use of coil springs in respect of materials having a diameter of 13.5 mm and with use of torsion bars in respect of materials having a diameter of 30 mm.

Further, the decarburization was measured by JIS G 0558 (SAE J 419) method, and the austenite grain sizes were measured by JIS G 0551 (ASTM E 112) quenching and tempering (Gh) method.

TABLE 7

| | | Sample materials bar diameter (mm) | Heating rate (°C./min) | Austenitizing temperatures (°C.) | Tempering temperatures (°C.) | Sagging ($10^{-4}$) (Residual shear strain) | Decarburization (mm) | Austenite grain sizes |
|---|---|---|---|---|---|---|---|---|
| High temperature rapid heating | A2 | Coil spring 13.5 | 1000 | 950 | 475 | 3.2 | 0.04 | 11.3 |

TABLE 7-continued

| | | Sample materials bar diameter (mm) | Heating rate (°C./min) | Austenitizing temperatures (°C.) | Tempering temperatures (°C.) | Sagging ($10^{-4}$) (Residual shear strain) | Decarburization (mm) | Austenite grain sizes |
|---|---|---|---|---|---|---|---|---|
| | " | Coil spring 13.5 | 5000 | 1050 | 480 | 2.8 | 0.07 | 10.8 |
| | A4 | Coil spring 13.5 | 1000 | 1050 | 460 | 3.8 | 0.06 | 11.8 |
| | " | Coil spring 13.5 | 5000 | 1150 | 470 | 3.5 | 0.09 | 11.0 |
| | A6 | Coil spring 13.5 | 1000 | 950 | 460 | 3.0 | 0.02 | 11.5 |
| | " | Coil spring 13.5 | 5000 | 1050 | 480 | 2.3 | 0.04 | 10.8 |
| | A10 | Torsion bar 30 | 1000 | 1050 | 480 | 2.9 | 0.04 | 10.6 |
| | A11 | Torsion bar 30 | 1000 | 1050 | 480 | 2.7 | 0.06 | 11.0 |
| Conventional method | B1 | Coil spring 13.5 | 50 | 880 | 450 | 4.5 | 0.14 | 9.2 |
| | " | Coil spring 13.5 | 50 | 950 | 450 | 4.2 | 0.35 | 8.5 |
| | " | Coil spring 13.5 | 50 | 1000 | 450 | 4.3 | 0.42 | 7.8 |

As is apparent from Table 7, the sagging of the coil springs having a diameter of 13.5 mm and prepared by the high temperature rapid heating was $2.3\text{–}3.8\times10^{-4}$, whereas the sagging of the coil springs prepared under the conventional heating conditions was $4.2\text{–}4.5\times10^{-4}$ thus showing that the values obtained by the invention were much superior to those of the conventional method.

Likewise, the sagging of torsion bars having a diameter of 30 mm was $2.7\text{–}2.9\times10^{-4}$ thus indicating superior values equivalent to the above coil springs.

From the above, it is apparent that the springs prepared by applying the high temperature rapid heating to the above steels of the present invention, have a superior sag-resistance.

Namely, by the application of the high temperature rapid heating to the above steels of the present invention, it was possible to dissolve a great amount of carbides of vanadium, and niobium in the austenite and to precipitate a great amount of fine carbides in the subsequent tempering step, whereby the secondary hardening was facilitated and the sag-resistance was thereby improved.

When the heating rate was as high as 1000° C./min or 5000° C./min with use of the high temperature rapid heating, even if the heating was conducted at a temperature as high as from 950° to 1150° C., it was possible to suppress the decarburization amount as low as from 0.002 to 0.09 mm as compared with from 0.14 to 0.42 mm according to the conventional method.

Further, if the high temperature rapid heating was applied to the above steels of the present invention, even when the heating was conducted at a temperature as high as 950° C. to 1150° C., it was possible to obtain an austenite grain size as fine as from 10.6 to 11.8 as compared with from 7.8 to 9.2 according to the conventional method, and thus a superior effect for the prevention of coarsening of austenite grains was obtainable.

As is apparent from the above results, in the case where a high temperature rapid heating is applied to the steel of the present invention, even when it is heated at a temperature as high as e.g. 1150° C., the decarburization amount is less than that by the conventional method and the austenite grain size is finer than attainable by the conventional method. Further, with respect to fatigue property, it has been confirmed that no breakage is observable in any one of the sample materials when they were subjected to a repeated loading for 200,000 times according to the fatigue test conducted by the method described in Examples 1 and 2.

What is claimed is:

1. A steel for a vehicle suspension spring having a good sag-resistance consisting essentially of by weight 0.50–0.80% carbon, 1.50–2.50% silicon, 0.50–1.50% manganese and 0.05–0.50% niobium, the remainder being iron together with impurities.

2. A steel according to claim 1 wherein the steel comprises by weight 0.55–0.65% carbon, 1.80–2.20% silicon, 0.70–1.00% manganese and 0.05–0.50% niobium, the remainder being iron together with impurities.

3. A steel according to claim 1 wherein the steel comprises by weight 0.50–0.80% carbon, 1.50–2.50% silicon, 0.50–1.50% manganese and 0.05–0.25% niobium, the remainder being iron together with impurities.

4. A steel according to claim 2 wherein the steel comprises by weight 0.55–0.65% carbon, 1.80–2.20% silicon, 0.70–1.00% manganese and 0.05–0.25% niobium, the remainder being iron together with impurities.

5. A steel for a vehicle suspension spring having a good sag-resistance consisting essentially of by weight 0.50–0.80% carbon, 1.50–2.50% silicon, 0.50–1.50% manganese, 0.05–0.50% niobium, a member or members selected from a group consisting of 0.05–0.50% vanadium and 0.05–0.50% molybdenum, 0.0005–0.01% boron and not greater than 0.0080% nitrogen, the remainder being iron together with impurities.

6. A steel according to claim 5 wherein the steel comprises by weight 0.55–0.65% carbon, 1.80–2.20% silicon, 0.70–1.00% manganese, 0.05–0.50% niobium, a member or members selected from a group consisting of 0.05–0.50% vanadium and 0.05–0.50% molybdenum, 0.0005–0.01% boron and not greater than 0.0080% nitrogen, the remainder being iron together with impurities.

7. A steel according to claim 6 wherein the steel comprises by weight 0.55–0.65% carbon, 1.80–2.20% silicon, 0.70–1.00% manganese, 0.05–0.25% niobium, 0.05–0.25% vanadium, 0.0005–0.005% boron and not greater than 0.0080 nitrogen, the remainder being iron together with impurities.

8. A steel according to claim 6 wherein the steel comprises by weight 0.55–0.65% carbon, 1.80–2.20% silicon, 0.70–1.00% manganese, 0.05–0.25% niobium, 0.05–0.25% molybdenum, 0.0005–0.005% boron and not greater than 0.0080% nitrogen, the remainder being iron together with impurities.

9. A steel according to claim 6 wherein the steel comprises by weight 0.55–0.65% carbon, 1.80–2.20% silicon, 0.70–1.00% manganese, 0.05–0.25% vanadium, 0.05–0.25% molybdenum, 0.05–0.25% niobium, 0.0005–0.005% boron and not greater than 0.0080% nitrogen, the remainder being iron together with impurities.

10. A steel according to claim 5 wherein the steel comprises by weight 0.50–0.80% carbon, 1.50–2.50% silicon, 0.50–1.50% manganese, 0.05–0.25% niobium, 0.05–0.25% molybdenum, 0.05–0.25% vanadium 0.0005–0.005% boron, and not greater than 0.0080% nitrogen, the remainder being iron together with impurities.

11. A steel according to claim 5 wherein the steel comprises by weight 0.50–0.80% carbon, 1.50–2.50% silicon, 0.50–1.50% manganese, 0.05–0.25% niobium, 0.05–0.25 molybdenum, 0.0005–0.005% boron, and not greater than 0.0080% nitrogen, the remainder being iron together with impurities.

12. A steel according to claim 5 wherein the steel comprises by weight 0.50–0.80% carbon, 1.50–2.50% silicon, 0.50–1.50% manganese, 0.05–0.25% vanadium, 0.05–0.25% niobium, 0.0005–0.005% boron and not greater than 0.0080% nitrogen, the remainder being iron together with impurities.

* * * * *